US008484762B2

(12) United States Patent
Goldstein

(10) Patent No.: US 8,484,762 B2
(45) Date of Patent: Jul. 16, 2013

(54) PROTECTIVE SPORTS HEADGEAR

(76) Inventor: Samuel A. Goldstein, West Chester, PA (US)

( * ) Notice: Subject to any disclaimer, the term of this patent is extended or adjusted under 35 U.S.C. 154(b) by 82 days.

(21) Appl. No.: 13/228,511

(22) Filed: Sep. 9, 2011

(65) Prior Publication Data

US 2013/0061372 A1 Mar. 14, 2013

(51) Int. Cl.
*A41D 13/00* (2006.01)

(52) U.S. Cl.
USPC ..... 2/9

(58) Field of Classification Search
USPC ..... 2/9, 411, 410, 412, 414, 424, 425
See application file for complete search history.

(56) References Cited

U.S. PATENT DOCUMENTS

| | | | | |
|---|---|---|---|---|
| 1,716,550 | A * | 6/1929 | Hart | 2/9 |
| 1,759,738 | A * | 5/1930 | Erario | 2/9 |
| 3,009,235 | A | 11/1961 | Mestral | |
| 3,984,875 | A | 10/1976 | Farquharson | |
| 4,222,122 | A * | 9/1980 | Toms | 2/9 |
| 4,754,501 | A * | 7/1988 | Yahn | 2/424 |
| 4,847,921 | A * | 7/1989 | Leutholt et al. | 2/425 |
| 5,184,354 | A * | 2/1993 | Alfaro et al. | 2/425 |
| 5,930,842 | A | 8/1999 | Burruss | |
| 6,024,446 | A | 2/2000 | Hall et al. | |
| 6,276,795 | B1 | 8/2001 | Hall et al. | |
| 6,289,522 | B1 | 9/2001 | Jones et al. | |
| 6,389,607 | B1 | 5/2002 | Wood | |
| 6,715,156 | B1 | 4/2004 | Purnell | |
| 6,782,558 | B1 | 8/2004 | Keen, Sr. et al. | |
| 7,168,095 | B2 | 1/2007 | Wright | |
| 2008/0010727 | A1 | 1/2008 | Keen | |
| 2008/0189821 | A1 | 8/2008 | Anderson | |

* cited by examiner

*Primary Examiner* — Tejash Patel
(74) *Attorney, Agent, or Firm* — Stradley Ronon Stevens & Young, LLP

(57) ABSTRACT

An adjustable and flexible sports headgear for protecting against injuries. A front panel protects the forehead, eyes, nose, and face of the wearer. The front panel extends from the forehead to the nose tip, allowing the wearer to breathe, and has a pair of openings that accommodate the eyes and permit unobstructed vision. A rear panel protects the back of the head and has two ends and a fastener connecting the ends to secure the headgear to the head. Side panels extend from opposite ends of the front panel to the rear panel. The side panels have ear protectors with apertures that facilitate hearing. Impact-absorbing padding is located along the front panel to protect the forehead and along the side panels to protect the temples. A strap connects the side panels with a releasable connector and, when connected, spans over the top of the head of the wearer.

20 Claims, 7 Drawing Sheets

PROTECTIVE SPORTS HEADGEAR

TECHNICAL FIELD

The invention is directed to a sports protective device. More particularly, the invention is directed to a sports protective device that is adjustable and prevents injuries to various areas of the head and face.

BACKGROUND OF THE INVENTION

Headgear for protecting an athlete's head, particularly for use during contact sports, is known. For example, helmets are utilized in football to protect the football player. In addition, helmets are used to protect lacrosse players, hockey players, baseball players, paintball players, and others. Even athletes who are not engaged in contact sports wear protective headgear, including bicyclists and wrestlers. Because the helmet that is worn by a particular athlete must comfortably and adequately fit the head of the wearer in order to protect the athlete, it is known to provide padding in the helmet. The padding provides additional protection for the wearer but can also assist in providing a comfortable fit for the wearer. As such, the padding engages with a relatively large surface area of the wearer's head. It is desirable for the padding to engage with a large surface area of the wearer's head in order to provide for adequate support and fit of the wearer's head within the helmet.

It is also known to be able to adjust the thickness of the padding within the helmet to provide for a more comfortable fit for a particular wearer. Again, however, the padding still engages with a large surface area of the head and is formed and adjusted to provide for protection and fit of the entire head within the helmet. The adjustable padding merely enhances the fit of the wearer's entire head within the helmet.

U.S. Pat. No. 6,389,607 issued to Wood discloses one example of a protective sports helmet designed for use in football and other contact sports. The helmet is preferably injection molded from a single, shock absorbing, homogenous piece of foam. An insert plate can be positioned near the user's forehead at the top and forward portion of the helmet. The purpose of the insert plate is to simulate the hardness of the user's head for heading a ball. A soccer player wearing the helmet can head the ball without injury to the head and the brain as potentially encountered without protection. The soft shell also minimizes injuries to other parts of the body that are struck by the helmet. Additional external components such as metal or plastic inserts can be inset molded into the foam. The purpose of these inserts is to improve stability and allow for attachment of face guards and a chin strap.

U.S. Pat. No. 3,984,875 issued to Farquharson discloses a protective head gear designed for use in hockey. The protective head gear has a helmet adapted to cover major portions of the athlete's head other than his face, and the helmet includes a peripheral brow portion extending between symmetrically disposed temple portions at either side of the helmet. A mouth guard is included for attachment to the temple portions and is shaped to extend from these portions symmetrically across the athlete's mouth. An upper peripheral portion of the mouth guard is aligned generally with the peripheral brow portion for underlying a curved eye shield so that, on impact, the eye shield will be supported by one or more of these portions.

U.S. Patent Application Publication No. 2008/0189821 discloses a protective mask of the kind having particular application for covering the eyes, ears, nose, and chin of one playing the game of paintball. The protective mask has a lens that can be quickly and easily removed for replacement as a consequence of paint splatter or cracking such as that caused by the impact by a paintball traveling at high speed. The protective mask also has a detachable head strap that is coupled to the lens through the mask. More particularly, a hole formed through an ear covering section of the mask is axially aligned with a hole formed through an ear covering section of the removable lens. One end of the detachable head strap is tied to a first connector. The first connector includes an upstanding locking catch that is moved into the axially aligned holes formed through the mask and the lens. A quick-release second connector has a rotatable latch that is responsive to a manual pushing force applied to the latch so as to move into interlocking mating engagement with the locking catch of the first connector. A lock is rotated from an unlocked position to a locked position to prevent the latch of the second connector from moving out of its mating engagement with the locking catch of the first connector. Accordingly, the first and second connectors will remain reliably connected together to prevent a separation of the removable lens and the detachable head strap from the protective mask.

In U.S. Pat. No. 6,289,522, Jones et al. disclose a wrestling headgear. The ear protector of the wrestling headgear includes an ear protection member and a variably adjustable support member disposed on an inner portion of the ear protection member. Jones et al. also disclose a method of defining an ear receiving cavity included in an ear protector of a wrestling headgear. The method includes configuring a variably adjustable support member, the variably adjustable support member disposed on an inner portion of an ear protection member.

Keen discloses, in U.S. Patent Application Publication No. 2008/0010727, a lightweight wrestling headgear. The headgear includes a pair of ear coverings and at least three straps that are coupled between the pair of ear coverings to secure the headgear onto the head of a wrestler. The pair of ear coverings each includes a relatively soft inner cushion and a relatively hard outer shell portion. The relatively hard outer shell portions have a deeply cupped portion formed with a symmetrical pattern of curved protrusions which each extend outward from a central portion of the relatively hard outer shell portions.

U.S. Pat. No. 6,715,156 issued to Purnell discloses a reversible protective headgear for wrestlers and other athletes who require protective covers for their ears during practice and contests. The headgear provides shock absorbency and protection for the ears and forehead in an easily adjustable and comfortable device that is also reversible from a first color to a second color and meets the requirements of international wrestling rules as promulgated by the International Federation of Associated Wrestling Styles (FILA).

U.S. Pat. No. 6,782,558 issued to Keen, Sr., et al. discloses a lightweight wrestler headgear. The headgear has an inner soft plastic cushion for contact with the wearer and an outer hard shell having a plurality of swirling or sweeping curved protrusions intended to suggest the swirling clouds of a tornado. In the depressions or valleys between the swirls are a large number of vent holes that effectively remain uncovered for good hearing regardless of the activity during a wrestling match. The inner cushion and outer shell are peripherally shaped with concave outer edges between locations where straps are attached to the inner cushion and outer shell. The peripheral shapes and the protruding swirls allow the outer shell to be made exceptionally light and strong with little impairment of hearing.

Different injuries are more common in different sports. For example, injuries to the nose are common in lacrosse, while injuries to the ears are common in wrestling. Therefore, many devices are designed to protect specific parts of the head, such as the forehead, eyes, cheeks, jaw, chin, mouth, ears, or nose of a user without protecting substantially the remainder of the user's head.

In U.S. Pat. No. 5,930,842, for example, Burruss discloses an ear protection device made of an insulating fabric that adjustably and releasably fastens to the retaining strap of an eye goggles unit. The device utilizes elastic to retain its lower edge proximate the head of the wearer under even severe conditions. The device is designed to protect the winter sports participant, such as a snowmobiler or skier, who experiences rapid movement in a sub-zero environment requiring protection of both the eyes and the ears.

In both U.S. Pat. No. 6,024,446 and No. 6,276,795, Hall et al. disclose protective eyewear for use in sports activities. The eyewear has particulate and liquid sealing around a frame containing a lens or lenses and has temples that provide adjustment of the eyewear to a pantoscopic angle. The eyewear is provided with an adjustable strap for better fit to the wearer's head. Included are a plurality of projections that define various pantoscopic angles. The temple end piece includes a set of recesses that engage the projections formed on the lens or frame; the temple end piece is rotated relative to the lens or frame to set the pantoscopic angle. The adjustable strap can be unbuckled for snap-locked attachment of the eyewear directly to other safety equipment such as noise-suppression ear muffs, communication head phones, breathing masks, and the like. A plurality of ventilation channels are disposed on the frame to provide indirect ventilation. The frame includes a skirt which is designed to prevent unwanted foreign matter, including liquids, from entering underneath the eyewear and making contact with the eyes of a user.

In U.S. Pat. No. 7,168,095, Wright characterizes current products on the market including, but not limited to, motorcycle helmets, snowboarding helmets, ski helmets, and the like, as meant to protect the entire head from falls or injury to the entire head and not used solely for front head and face protection. All are comprised of some type of hard material, are full-shelled helmets, are not compactable, and do not allow for efficient stowing and storage. These helmets are also heavy and are susceptible to mildew when used in wet environments and not dried or stored in dry environments (e.g., boats). Therefore, Wright discloses and claims a method of using a face protector only to protect the front of a user's head (i.e., forehead, face, eyes, cheeks, jaw, chin, mouth, and nose) from the elements associated with outdoor activities.

Head protection gear typically protects the entire head from falls, such as with a bike helmet, the eyes only, such as with protective goggles, or the ears and forehead, such as with wrestling headgear. Much of this gear is bulky and does not provide adequate protection to more than one or two areas of the head. In addition, the gear is often suited for just one or two sports and not useful for a variety of sporting activities.

Accordingly, there is a need for a sports protective device that may be worn to prevent injuries to the face, ears, and head and used during performance of a variety of sporting activities. There is also a need for a sports protective device that is comfortable and does not affect a user's performance of a sport.

BRIEF SUMMARY OF THE INVENTION

To meet these and other needs, and in view of its purposes, the invention provides an improved sports protective device. One aspect of this invention provides a sports headgear for protecting the forehead, the temple, the eyes, the ears, the nose, the face, and the back of the head of a wearer. The headgear has a flexible front panel that covers, conforms to, and protects the forehead, the eyes, the nose, and the face of the wearer. The front panel covers the face from the forehead to the tip of the nose such that the wearer can breathe and has a pair of openings that accommodate the eyes and permit the wearer unobstructed vision. A flexible rear panel covers, conforms to, and protects the back of the head of the wearer and has a first end, a second end, and a fastener connecting the ends together to secure the headgear to the head of the wearer.

A pair of flexible side panels extend from opposite ends of the front panel to the rear panel. The side panels have ear protectors and the ear protectors have apertures to accommodate and protect the ears and facilitate hearing by the wearer. Impact-absorbing padding is located along at least a portion of the front panel to protect the forehead and along the side panels to protect the temples. An adjustable strap connects the side panels to one another with a releasable connector and, when connected, spans over the top of the head of the wearer.

It is to be understood that both the foregoing general description and the following detailed description are exemplary, but are not restrictive, of the invention.

BRIEF DESCRIPTION OF THE DRAWINGS

The invention is best understood from the following detailed description when read in connection with the accompanying drawings. It is emphasized that, according to common practice, the various features of the drawings are not to scale. On the contrary, the dimensions of the various features are arbitrarily expanded or reduced for clarity. Included in the drawings are the following figures.

DETAILED DESCRIPTION OF THE INVENTION

Figure 1:
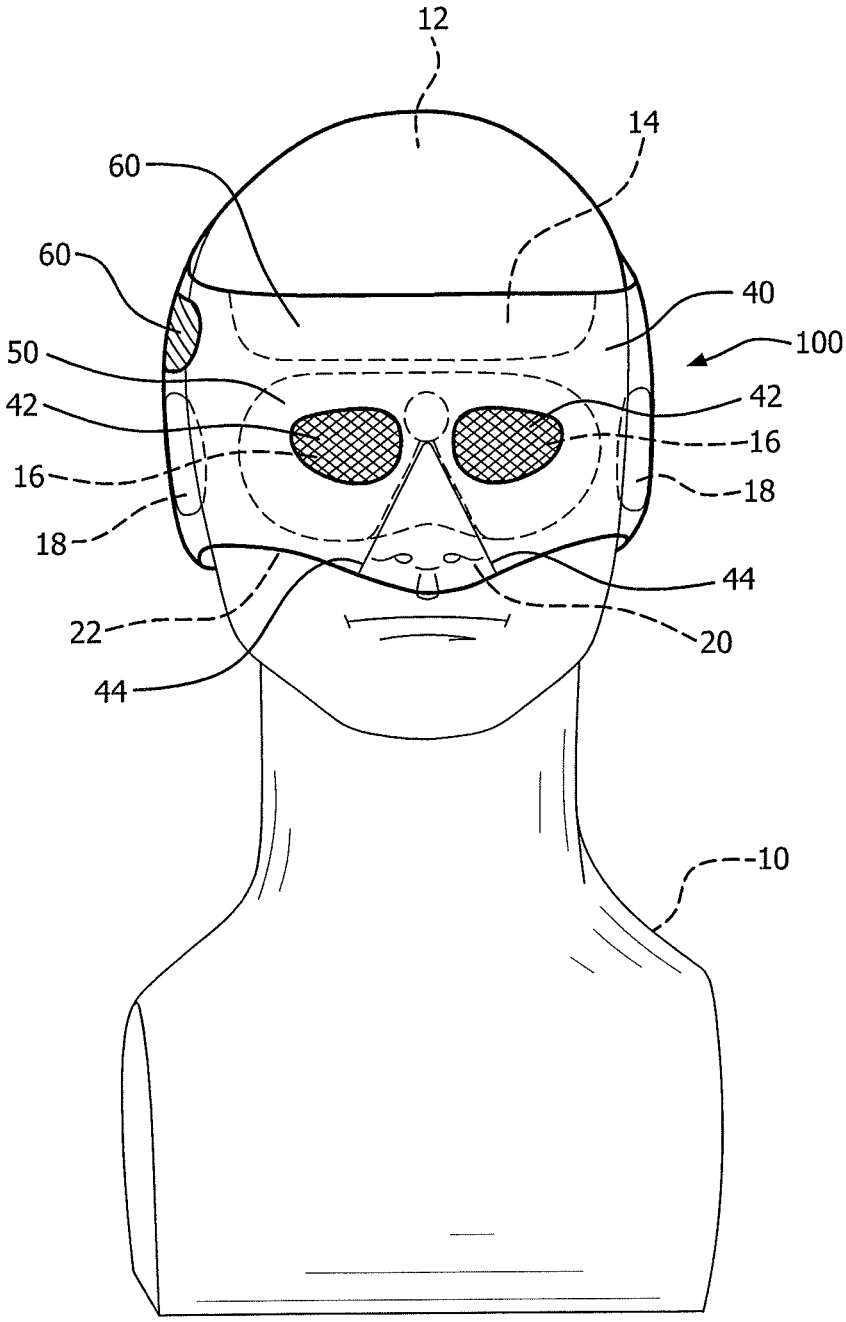
FIG. 1 is a front view of one embodiment of the headgear of the invention.
Figure 3:
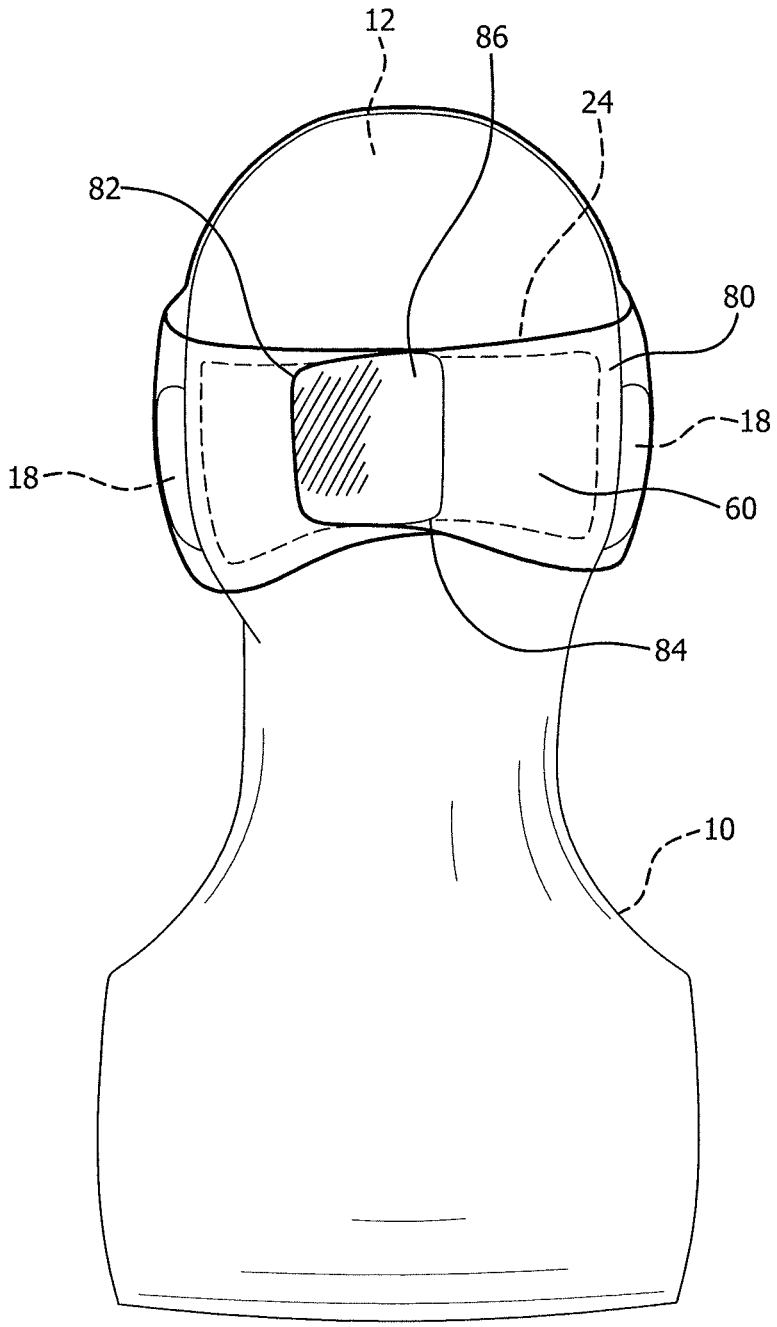
FIG. 3 is a rear view of the headgear of the invention.

Referring now to the drawings, in which like reference numbers refer to like elements throughout the various figures that comprise the drawings, FIG. 1 shows a front view of an embodiment of the invention in place on a wearer 10. The invention is directed to a protective sports headgear 100 for helping to prevent injury to several areas of the head 12 of the wearer 10. Among the areas of the wearer 10 protected by the headgear 100 are the forehead 14, the eyes 16, the ears 18, the nose 20, and the face 22. As shown in FIG. 3, the headgear 100 also protects the back 24 of the head 12 of the wearer 10.

Figure 8:
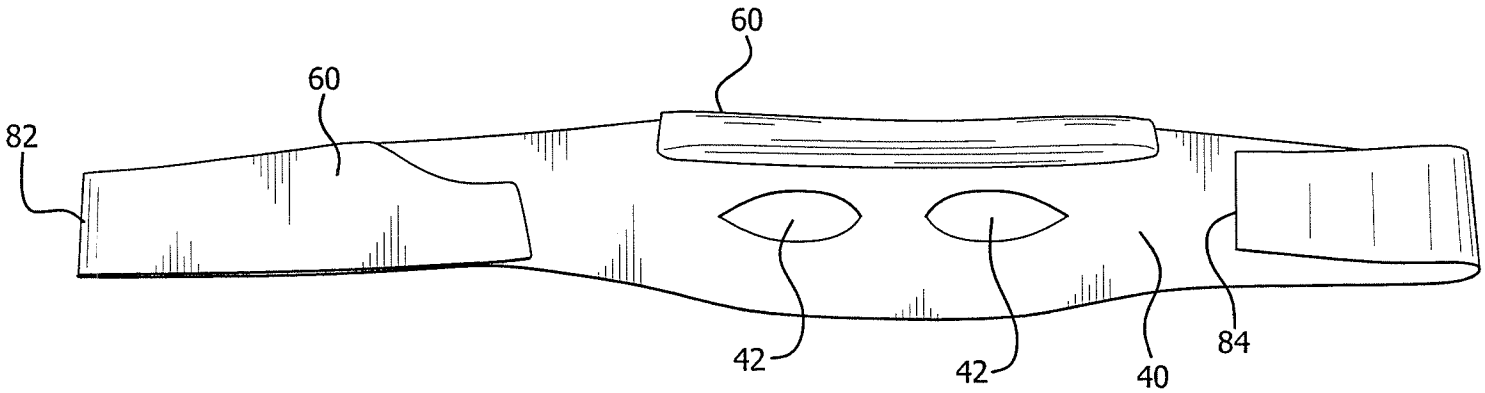
FIG. 8 depicts various components of the headgear of the invention when laid substantially flat, highlighting the padding and an alternative shape for the eye openings.

In the embodiment shown in FIG. 1, the headgear 100 has a flexible front panel 40 that covers, conforms to, and protects the forehead 14, the eyes 16, the nose 20, and the face 22 of the wearer 10. The front panel 40 covers the face 22 from the forehead 14 to the tip of the nose 20, leaving the nostrils open so that the wearer 10 can breathe. A pair of openings 42 in the front panel 40 accommodate the eyes 16 and permit the wearer 10 unobstructed vision. The openings 42 may be of different sizes and shapes to accommodate different types of eyes 16 (or for aesthetic reasons). The embodiment of the front panel 40 illustrated in FIG. 1, for example, has oval openings 42. Other shapes are possible, including round or, as illustrated in FIG. 8, tapered cat-like openings 42.

The front panel 40 has one or more darts 44. Darts 44 are typically garment construction features used to shape a flat piece of fabric to the curves of the body. Darts 44 can be straight, for an easy fit, or curved for a closer-to-the body fit. Darts 44 are typically found in areas where the body is the most contoured. The front panel 40 incorporates darts 44 to shape the otherwise flat material of the front panel 40 to the contours of the face 22 of the wearer 10. In the example embodiment shown in FIG. 1, the darts 44 outline the nose 20 to help the front panel 40 conform to the nose 20. The darts 44 may be at different locations to accommodate different shapes of noses 20. Additional or alternative darts 44 may be included in the front panel 40 (or other components of the headgear 100) to form-fit the headgear 100 to the wearer 10.

Figure 5:
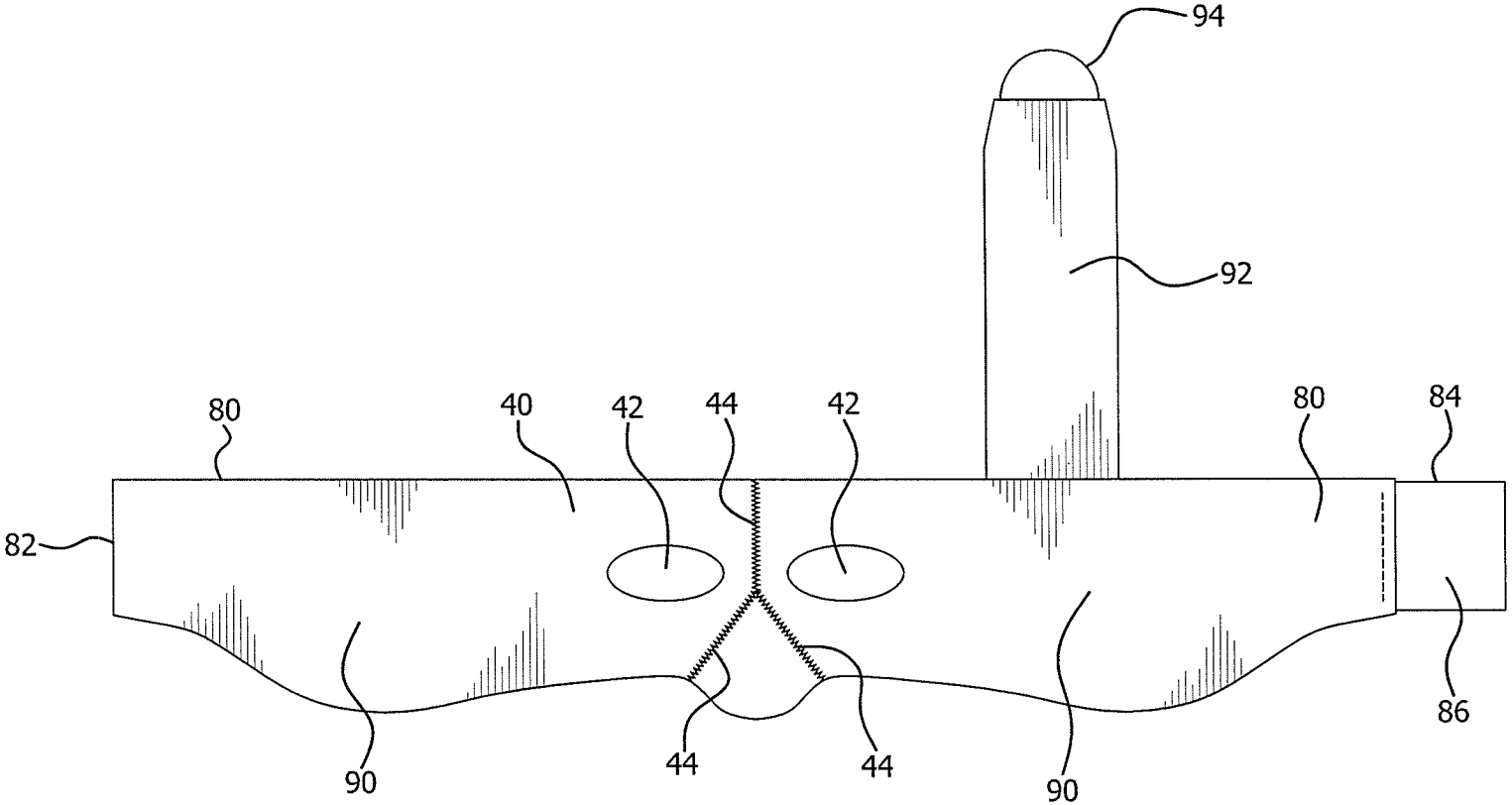
FIG. 5 depicts various components of the headgear of the invention when laid substantially flat and before use by the wearer.

Note the vertical dart 44 included in the embodiment of the front panel 40 illustrated in FIG. 5. The vertical dart 44 helps the front panel 40 conform to the forehead 14 of the wearer 10. FIG. 5 depicts various components of the headgear 100 when laid substantially flat and before use by the wearer 10.

The headgear 100 may be used in combination with a conventional mask 50. As illustrated as a separate component in FIG. 6, the mask 50 is shaped to offer enhanced protection for the eyes 16 and the nose 20 of the wearer 10. The mask 50 is typically formed of a clear, soft, malleable plastic material, designed to absorb significant impact while conforming to the face 22. The mask 50 may also be rigid and formed to fit the face 22. This rigid mask 50 may be made of plastic or a similar material.

The mask 50 may be held in position against the wearer 10 by the front panel 40 via pressure, may be affixed to the wearer 10 by its own independent attachment mechanism (e.g., a strap that encircles the head 12 of the wearer 10), or may be inserted in a pouch provided in the front panel 40. The mask 50 may be permanently affixed to the front panel 40 or removable. In one embodiment, the mask 50 is held onto the front panel 40 via a Velcro® fastener.

Velcro® is the brand name of the first commercially marketed fabric hook-and-loop fastener and is sold by Velcro USA, Inc. of Manchester, N.H. The fastener was invented by George de Mestral. See U.S. Pat. No. 3,009,235. Hook-and-loop fasteners consist of two components: typically, two lineal fabric strips or tapes (alternately round dots or squares) which are attached (e.g., sewn, adhered, etc.) to the opposing surfaces to be fastened. The first component features tiny hooks (e.g., the hook tape); the second features even smaller and "hairier" loops (e.g., the loop tape). When the two surfaces are pressed together, the hooks catch in the loops—and the two pieces fasten or bind temporarily. When separated, by pulling or peeling the two surfaces apart, the Velcro® strips make a distinctive "ripping" sound.

The headgear 100 has padding 60, or impact-absorbing material, at various locations to further prevent injuries. The padding 60 is helpful, for example, in absorbing shock and preventing concussions. As shown in FIG. 1, and highlighted in FIG. 8, the front panel 40 has padding 60 to protect both the forehead 14 and the temple of the wearer 10. The padding 60 may be made of the same material as the headgear 100 or a different material, such as foam. Thermoplastic foams, such as polyurethane foam, polyolefin foam, and mixtures of such materials may be used. The padding 60 is generally thicker than the rest of the headgear 100. The padding 60 may be sewn into the headgear 100 or otherwise attached. The padding 60 may be sandwiched between two pieces of material or attached to one piece on the inside of the headgear 100. Preferably, the padding 60 is flexible when subject to pressure.

Figure 2:
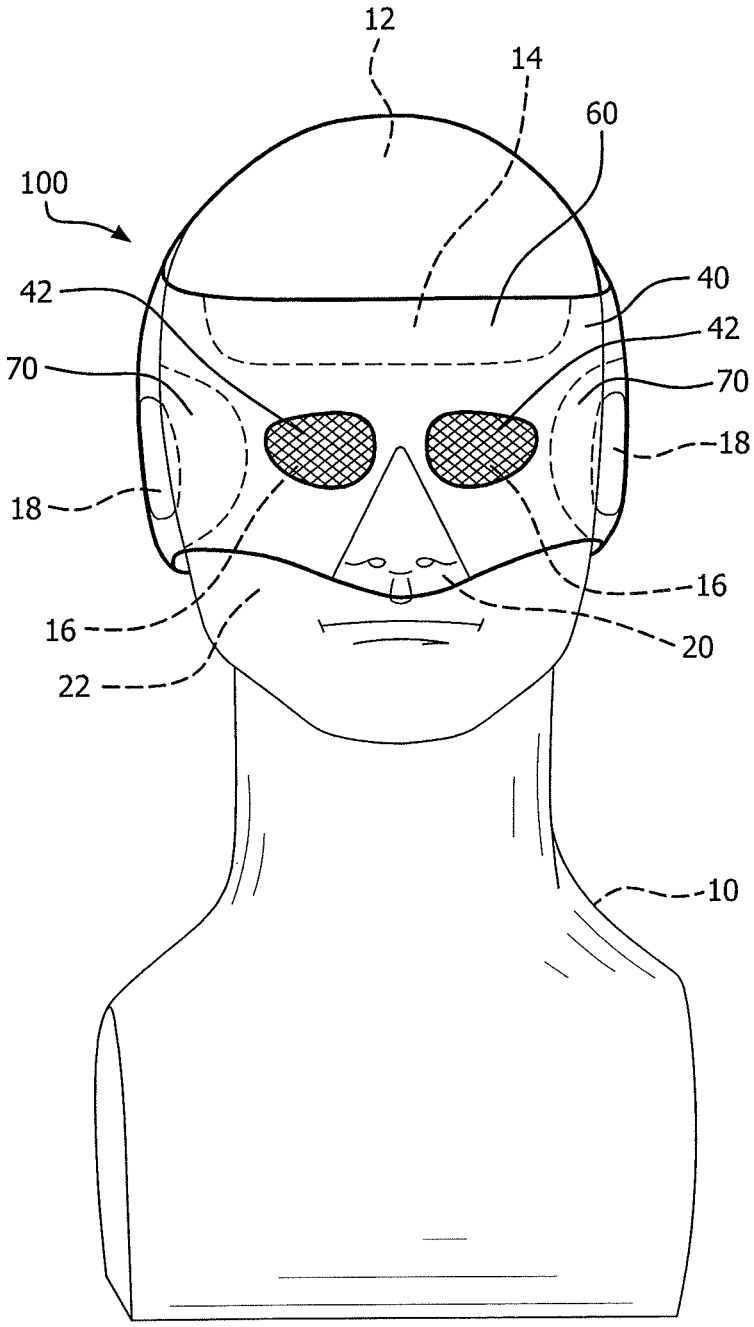
FIG. 2 is a front view of another embodiment of the headgear of the invention.

The embodiment of the headgear 100 illustrated in FIG. 2 differs from the embodiment of FIG. 1 in two, main respects. First, the headgear 100 of FIG. 2 does not include the mask 50. Second, the headgear 100 of FIG. 2 includes ear protectors 70. As illustrated as a separate component in FIGS. 7A and 7B, the ear protectors 70 may be constructed as an integral component or as a layered component. By "integral" is meant a single piece or a single unitary part that is complete by itself without additional pieces, i.e., the part is of one monolithic piece formed as a unit. The integral ear protectors 70 may be constructed of the same material as the padding 60, or a similar material such as foam, a mesh, or any other suitable material. Integral ear protectors 70 are shown in FIG. 7A and have a single first layer 72.

Figure 7B:
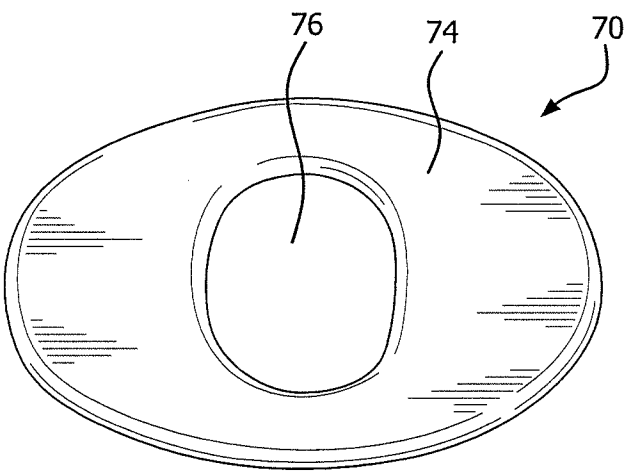
FIG. 7B illustrates an alternative ear protector having two layers.
Figure 7A:
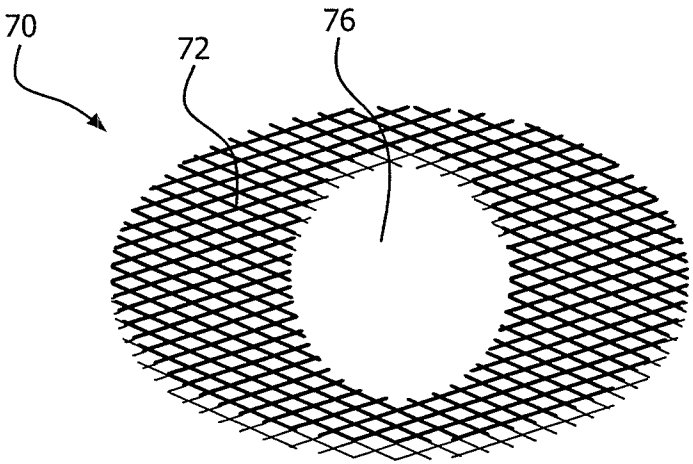
FIG. 7A illustrates one component of the headgear of the invention, namely an integral ear protector having a single first layer.

Alternatively, as shown in FIG. 7B, the ear protectors 70 may be constructed of multiple layers. The first layer 72 may be a mesh material, for example, while the second layer 74 may be a foam or cloth material covering the first layer 72. The primary functions of the second layer 74 are to give the ear protectors 70 a soft feel and to prevent abrasion. The primary functions of the first layer 72 are to absorb impact and to prevent injury.

Each ear protector 70 has an aperture 76 to accommodate the ears 18. The aperture 76 may be of any size and any shape, with a substantially oval shape illustrated in FIGS. 7A and 7B. The aperture 76 allows for better hearing for the wearer 10 when using the headgear 100. The aperture 76 may be open to the atmosphere, as shown, or may be covered with a layer of material that overlays the ear protector 70. If material overlays the ear protector 70, vent holes may be added to allow air circulation to the ears 18.

As shown in FIG. 3, the headgear 100 has a rear panel 80 with two ends 82 and 84 connected to each other via a fastener 86 at the back 24 of the head 12. The fastener 86 is preferably a hook-and-loop fastener and is more preferably a Velcro® fastener. The hook portion of the fastener 86 is secured to one end 82 and the loop portion is secured to the other end 84. The fastener 86 is adjustable in that it fits any size head 12 by adjusting the fastener 86. The fastener 86 is also releasable. As illustrated in FIG. 3, the rear panel 80 may also include padding 60 for enhanced protection of the wearer 10.

Figure 4:
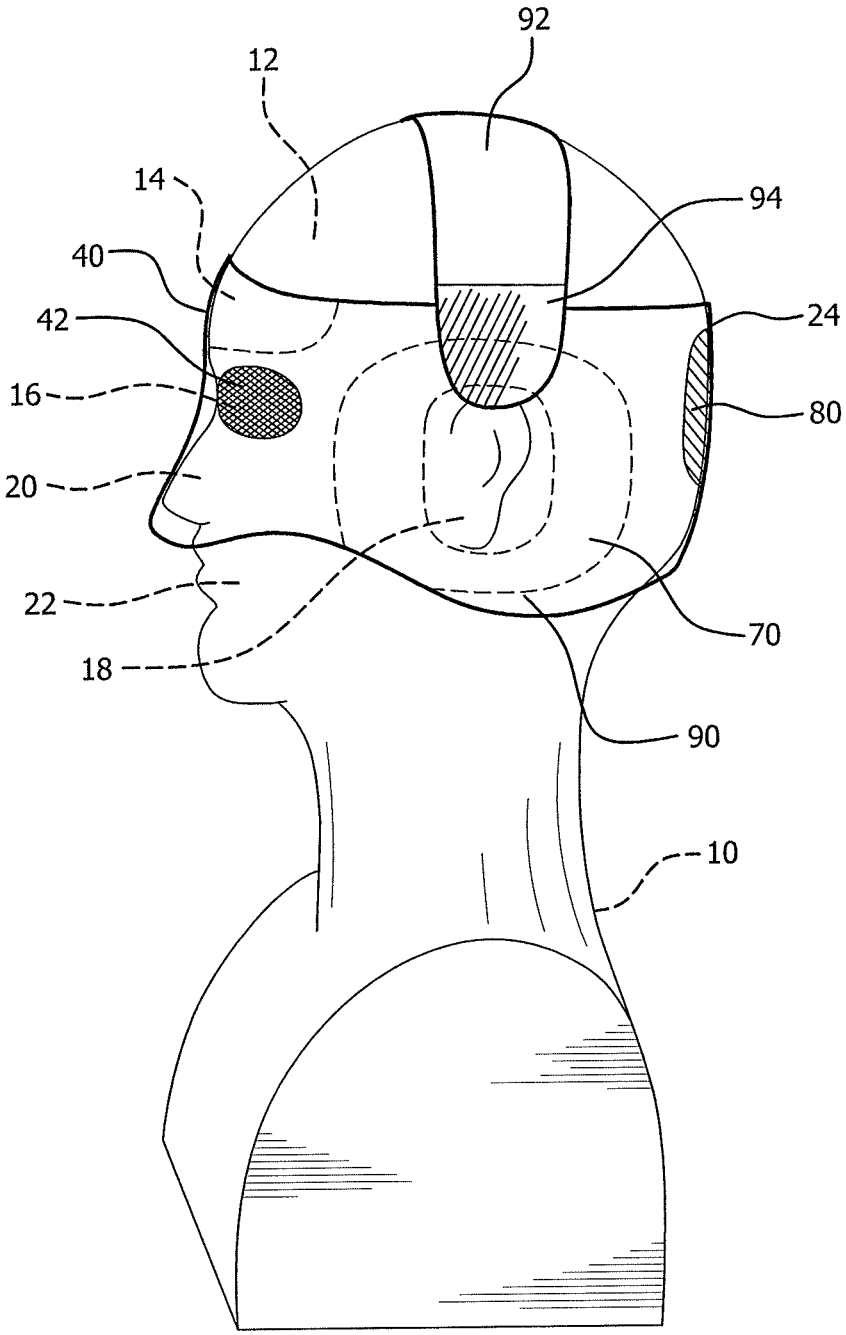
FIG. 4 is a side view of the headgear of the invention.

The headgear 100 also has side panels 90, one of which is shown in FIG. 4. (As shown in FIG. 5, the front panel 40, the rear panel 80, and the side panels 90 may form an integral unit.) The side panels 90 are connected to one another by an adjustable strap 92. One end of the strap 92 is substantially permanently affixed to a side panel 92, such as by stitching (i.e., the one end is sewn to the side panel 92). See FIG. 5. The opposite end of the strap 92, which is shown in FIG. 4, has a connector 94 that attaches to the side panel 90 above the ear 18. The connector 94 is preferably a hook-and-loop material and is more preferably a Velcro® material. The hook portion is secured to either the strap 92 or the side panel 90 and the loop portion is secured to the opposite component: whichever of the side panel 90 or the strap 92 does not have the hook portion. The strap 92 is adjustable in that it fits any size head 12 by adjusting the connector 94. The connector 94 is also releasable.

When the wearer 10 uses the headgear 100, the strap 92 lies over the top of the head 12. The headgear 100 is positioned on the head 12 of the wearer 10 using only a single strap 92. (It is also possible, however, for the headgear 100 to include additional straps such as a crossing strap that connects to the front panel 40 and to the rear panel 80 and lies over the top of the head 12.) The strap 92 helps to keep the headgear 100 from slipping downward and provides for a proper fit. The adjustable strap 92 may also have padding 60.

The headgear 100 fits comfortably on the wearer 10. To assure comfort, the various components of the headgear 100 are made of a flexible material, such as a mesh, polyurethane, or any other material that is breathable and does not irritate the skin. The headgear 100 may be formed of a polymer sheet. "Flexible" means that the material is able to be twisted and shaped, but does not necessarily mean that the material must be stretchable (although the material may be stretchable).

"Polyurethane" identifies any polymer consisting of a chain of organic units joined by urethane links. Polyurethane polymers are formed through step-growth polymerization by reacting a monomer containing at least two isocyanate functional groups with another monomer containing at least two hydroxyl (alcohol) groups in the presence of a catalyst. Polyurethanes are widely used in high-resiliency flexible foam components. Polyurethane materials pass air, allowing the materials to breathe, while providing a sufficient coefficient of friction to avoid slippage.

One example of a mesh material is the DEFLEXION™ material made by Dow Corning Corporation of Midland, Mich. The DEFLEXION™ material is an impact-protection textile based on three dimensional polyester spacer textiles impregnated with specially formulated silicones. The material offers high protection while remaining comfortable, and good fit with freedom of movement. The material is durable, washable, and water-resistant. It provides excellent breathability and works across temperature extremes without becoming rigid (−20° C. to +40° C.). The DEFLEXION™ material is especially well suited for the first layer 72 of the ear protector 70.

The various components of the headgear 100 may be of any thickness as long as the thickness renders the headgear 100 comfortable to the wearer 10 while protecting the wearer 10. Preferably, the thickness of the material used to construct the headgear 100 is about 1 mm to 10 mm (0.04 to 0.40 inches). More specifically, the thickness of the material or materials used to construct the headgear 100 may be 6.35 mm (0.25 inches) or 3.175 mm (0.125 inches). Preferably, the headgear 100 is thicker in places where the padding 60 is located. A thicker material may be used for the front panel 40, the padding 60, or both components, while a thinner material may be used for the rear panel 80 and the ear protectors 70. The material may be thinner in those areas where less protection is need for specific sports.

EXAMPLE

A prototype headgear 100 has been constructed. The approximate dimensions of that prototype are summarized for purposes of example only and to more clearly demonstrate the overall nature of the invention. These dimensions are exemplary, not restrictive, of the invention.

With reference to FIG. 5, the length of the headgear 100 from end 82 to end 84 is about 600 mm (23.6 inches). The height of the headgear 100 at the location of the vertical dart 44 is between about 115 mm (4.5 inches) and 127 mm (5.0 inches) and, for example, is about 120 mm (4.72 inches). The eye openings 42 are about 60 mm (2.36 inches) long and about 30 mm (1.18 inches) high at their greatest height. The fastener 86 is about 65 mm (2.56 inches) long and about 60 mm (2.36 inches) high. The strap 92 is about 240 mm (9.45 inches) long and 65 mm (2.56 inches) wide.

Figure 6:
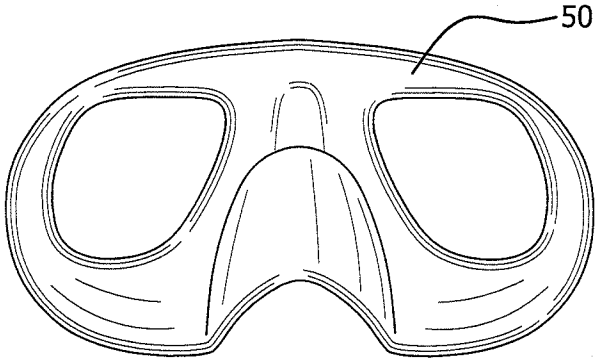
FIG. 6 shows a conventional mask that may be used in combination with the headgear of the invention.

With reference to FIG. 6, the mask 50 is about 150 mm (5.91 inches) long, 70 mm (2.76 inches) high, and 2 mm (0.08 inches) thick. The example ear protectors 70 illustrated in FIGS. 7A and 7B are about 145 mm (5.71 inches) long and 100 mm (3.94 inches) high, with a center aperture 76 that is about 55 mm (2.17 inches) long and 70 mm (2.76 inches) high. Turning to FIG. 8, the padding 60 located to protect the forehead 14 is about 230 mm (9.06 inches) long, 35 mm (1.38 inches) high, and 10 mm (0.40 inches) thick. The padding 60 located to protect the back 24 of the head 12 of the wearer 10 is about 210 mm (8.27 inches) long, 65 mm (2.56 inches) high, and 10 mm (0.40 inches) thick.

Whatever the dimensions selected for the headgear 100, those dimensions are predetermined before construction of the headgear 100. By "predetermined" is meant determined beforehand, so that the predetermined characteristic (e.g., the dimension) must be determined, i.e., chosen or at least known, in advance of some event (e.g., construction of the headgear 100). Of course, the adjustability of the headgear 100 renders the choice of the dimensions for the headgear 100 somewhat less critical than those dimensions might otherwise be. The headgear 100 is rendered adjustable by the flexible materials of construction and by components such as the fastener 86 and the connector 94.

Other protective devices and sporting gear may be worn or added to the headgear 100. Example devices include, without limitation, a mouth guard, a helmet, a hat, goggles, or a chin strap. All such devices may be easily worn in combination with the headgear 100.

Although the invention has been described in detail and with reference to specific embodiments, it will be apparent to one skilled in the art that various changes and modifications can be made without departing from the spirit and scope of the invention. For example, the sports protective device may come in a variety of colors and shapes. The sports protective device may also be personalized according to the wearer and may be reversible. Thus, it is intended that the invention covers the modifications and variations of this invention provided they come within the scope of the appended claims and their equivalents. It is expressly intended, for example, that all ranges broadly recited in this document include within their scope all narrower ranges which fall within the broader ranges.

What is claimed is:

1. A sports headgear for protecting the forehead, the temple, the eyes, the ears, the nose, the face, and the back of the head of a wearer, the headgear comprising:

a flexible front panel that covers, conforms to, and protects the forehead, the eyes, the nose, and the face of the wearer, the front panel covering the face from the forehead to the tip of the nose such that the wearer can breathe and having a pair of openings that accommodate the eyes and permit the wearer unobstructed vision;

a flexible rear panel covering, conforming to, and protecting the back of the head of the wearer and having a first end, a second end, and a fastener connecting the ends together to secure the headgear to the head of the wearer;

a pair of flexible side panels extending from opposite ends of the front panel to the rear panel, the side panels having ear protectors and the ear protectors having apertures to accommodate and protect the ears and facilitate hearing by the wearer;

impact-absorbing padding located along at least a portion of the front panel to protect the forehead and along at least a portion of the side panels to protect the temples; and an adjustable strap that connects the side panels to one another with a releasable connector and, when connected, spans over the top of the head of the wearer, wherein the front panel, the rear panel, the side panels, and the adjustable strap are adapted to be laid substantially flat before use by the wearer.

2. The sports headgear of claim 1 further comprising a mask shaped to offer enhanced protection for the eyes and the nose of the wearer, the mask held in position against the wearer by the front panel.

3. The sports headgear of claim 1 wherein the impact-absorbing padding is further located along at least a portion of the rear panel to protect the back of the head of the wearer.

4. The sports headgear of claim 1 wherein the front panel has darts that outline the nose to help the front panel conform to the nose of the wearer.

5. The sports headgear of claim 1 wherein the front panel has a vertical dart helping the front panel conform to the forehead of the wearer.

6. The sports headgear of claim 1 wherein the connector comprises a hook-and-loop connector.

7. The sports headgear of claim 1 wherein the fastener comprises a hook-and-loop fastener.

8. The sports headgear of claim 1 wherein the strap has a first end substantially permanently affixed to one of the side panels, and the opposite end has the connector that releasably attaches to the other side panel.

9. The sports headgear of claim 1 wherein the padding comprises foam.

10. The sports headgear of claim 1 wherein the front panel, the rear panel, and the side panels form an integral unit.

11. The sports headgear of claim 1 wherein the padding has a thickness of about 1 to 10 mm.

12. A sports headgear for protecting the forehead, the temple, the eyes, the ears, the nose, the face, and the back of the head of a wearer, the headgear comprising:

a flexible front panel that covers, conforms to, and protects the forehead, the eyes, the nose, and the face of the wearer, the front panel covering the face from the forehead to the tip of the nose such that the wearer can breathe, having a pair of openings that accommodate the eyes and permit the wearer unobstructed vision, and including darts that outline the nose to help the front panel conform to the nose of the wearer;

a flexible rear panel covering, conforming to, and protecting the back of the head of the wearer and having a first end, a second end, and a fastener connecting the ends together to secure the headgear to the head of the wearer;

a pair of flexible side panels extending from opposite ends of the front panel to the rear panel, the side panels having ear protectors and the ear protectors having apertures to accommodate and protect the ears and facilitate hearing by the wearer;

impact-absorbing padding located along at least a portion of the front panel to protect the forehead, along at least a portion of the side panels to protect the temples, and along at least a portion of the rear panel to protect the back of the head of the wearer; and an adjustable strap that connects the side panels to one another, the strap having a first end substantially permanently affixed to one of the side panels and an opposite end with a releasable connector that attaches to the other side panel such that, when connected, the strap spans over the top of the head of the wearer. wherein the front panel, the rear panel, the side panels, and the adjustable strap are adapted to be laid substantiall flat before use b the wearer.

13. The sports headgear of claim 12 further comprising a mask shaped to offer enhanced protection for the eyes and the nose of the wearer, the mask held in position against the wearer by the front panel.

14. The sports headgear of claim 12 wherein the front panel has a vertical dart helping the front panel conform to the forehead of the wearer.

15. The sports headgear of claim 12 wherein the connector comprises a hook-and-loop connector.

16. The sports headgear of claim 12 wherein the fastener comprises a hook-and-loop fastener.

17. The sports headgear of claim 12 wherein the padding comprises foam.

18. The sports headgear of claim 12 wherein the front panel, the rear panel, and the side panels form an integral unit.

19. The sports headgear of claim 12 wherein the padding has a thickness of about 1 to 10 mm.

20. A sports headgear for protecting the forehead, the temple, the eyes, the ears, the nose, the face, and the back of the head of a wearer, the headgear comprising:

a flexible front panel that covers, conforms to, and protects the forehead, the eyes, the nose, and the face of the wearer, the front panel covering the face from the forehead to the tip of the nose such that the wearer can breathe, having a pair of openings that accommodate the eyes and permit the wearer unobstructed vision, and including darts that outline the nose to help the front panel conform to the nose of the wearer and a vertical dart helping the front panel conform to the forehead of the wearer;

a mask shaped to offer enhanced protection for the eyes and the nose of the wearer, the mask held in position against the wearer by the front panel;

a flexible rear panel covering, conforming to, and protecting the back of the head of the wearer and having a first end, a second end, and a hook-and-loop fastener connecting the ends together to secure the headgear to the head of the wearer;

a pair of flexible side panels extending from opposite ends of the front panel to the rear panel, the side panels having ear protectors and the ear protectors having apertures to accommodate and protect the ears and facilitate hearing by the wearer;

impact-absorbing padding located along at least a portion of the front panel to protect the forehead, along at least a portion of the side panels to protect the temples, and along at least a portion of the rear panel to protect the back of the head of the wearer; and an adjustable strap that connects the side panels to one another, the strap having a first end substantially permanently affixed to one of the side panels and an opposite end with a hook-and-loop connector that attaches to the other side panel such that, when connected, the strap spans over the top of the head of the wearer, wherein the front panel, the rear panel, and the side panels form an integral unit and wherein the front panel, the rear panel, the side panels, and the adjustable strap are adapted to be laid substantially flat before use by the wearer.

* * * * *